US006237656B1

(12) United States Patent
Whitehead et al.

(10) Patent No.: US 6,237,656 B1
(45) Date of Patent: May 29, 2001

(54) PENCIL SHARPENER BIT

(76) Inventors: Dale Whitehead, 3218 Boxley Valley Rd.; Douglas M. Henry, 1179 Glenbrook Dr., both of Franklin, TN (US) 37064

( * ) Notice: Subject to any disclaimer, the term of this patent is extended or adjusted under 35 U.S.C. 154(b) by 0 days.

(21) Appl. No.: 09/551,511

(22) Filed: Apr. 18, 2000

(51) Int. Cl.[7] ..... B43L 23/08
(52) U.S. Cl. ..... 144/28.3; 30/457; 30/122
(58) Field of Search ..... 30/457, 456, 453, 30/451, 458, 454, 452, 122, 462, 124, 125; 144/28.11, 28.3, 28.6; 408/226

(56) References Cited

U.S. PATENT DOCUMENTS

| | | | | |
|---|---|---|---|---|
| 510,518 | * | 12/1893 | Price | 144/28.11 |
| 762,754 | * | 6/1904 | Perkins | 30/457 |
| 2,366,928 | * | 1/1945 | Paschell | 30/457 |
| 2,470,387 | * | 5/1949 | Baggett | 144/28.11 |
| 3,049,096 | * | 8/1962 | Hampton | 144/28.11 |
| 4,598,478 | * | 7/1986 | Buschle | 30/457 |
| 5,647,138 | * | 7/1997 | Tang et al. | 30/457 |

* cited by examiner

*Primary Examiner*—Rinaldi I. Rada
*Assistant Examiner*—Omar Flores-Sánchez

(57) ABSTRACT

A pencil sharpener bit for use in sharpening pencils utilizing a portable electric drill, any motorized hand tool supporting the use of a chuck assembly or any hand held tool accepting tips with hexagonal ends is disclosed. The sharpener assembly rotates in a standard clockwise motion while the pencil is held by hand in a stationary position. The sharpener frame is of sufficient size to completely encase the point cutting assembly. The said point cutting assemble is set at a sufficient depth to remove successive layers of a pencil resulting in a conically shaped point. The sharpening assembly removes only enough material to bring the pencil to a sufficient point of sharpness. A slot is provided for material dispersal and collection in an outer cover. The housing of the sharpener is cylindrical in shape and is attached to a hexagonally shaped shaft bit intended for use with any standard chuck with three jaws or teeth.

4 Claims, 1 Drawing Sheet

PENCIL SHARPENER BIT

CROSS-REFERENCE OF RELATED APPLICATIONS

Not applicable

BACKGROUND

1. Field of Invention

The present invention relates to pencil sharpeners, and more particularly, to a pencil sharpener for use with portable electric drills.

BACKGROUND

2. Description of Prior Art

Prior pencil sharpeners include various devices that sharpen wood/composite pencils and also house the pencil shavings and chipped lead or graphite for later disposal. Prior pencil sharpeners also include housings for the sharpened points of pencils. However, prior portable pencil sharpeners are dependent upon manual manipulation to create the sharpened int. Small, battery powered units are too bulky to be carried on the body of the user and are not convenient to use. Pencils sharpened by manual methods, such as a knife, do not easily produce finely shaped tapered points.

Accordingly, there is a need for a pencil sharpener that can be powered by an external source such as a portable electric drill and quickly produce a sharply defined point. In addition, there is a need for a highly portable pencil sharpener. Further, there is a need for a device as described above that is easily and economically produced.

U.S. Pat. No. 329,486 issued to Price on Nov. 3, 1885 describes a pencil sharpener which includes a dust chamber that reduces the noise generated by the sharpening process, by enclosing the outside of the cutter-holder and pencil guide. This pencil sharpener does not provide a means for insertion in a portable electric drill. This device also does not include a cover for the discharge outlet, thus permitting the discharge of pencil shavings and potential contact between the user and the cutting blades.

U.S. Pat. No. 661,955 issued to Cranstone on Nov. 20, 1900 describes a combination pencil point protector and sharpener. This device does not include a means for insertion in a portable electric drill or a cover that collects discharged pencil shavings and protects the user from accidental contact between the user and cutting blades.

U.S. Pat. No. 703,967 issued to O'Byrne on Aug. 21, 1902 describes a wood pencil sharpener which is constructed to cut the wood of the pencil with the grain, to avoid the breaking or splitting of the wood. This device does not include a means for insertion in a portable electric drill or a cover that collects discharged pencil shavings and protects the user from accidental contact between the user and cutting blades.

U.S. Pat. No. 879,998 issued to Augir on Feb. 25, 1908 describes a novelty device adapted for use as a pencil sharpener having an anterior chamber adapted to receive pencil shavings and dust produced by sharpening a pencil. This device does not include a means for insertion in a portable electric drill or a cover that collects discharged pencil shavings and protects the user from accidental contact between the user and cutting blades.

U.S. Pat. No. 1,780,371 issued to Benczalski on Nov. 4, 1930 describes another pencil sharpener. This sharpener device is covered by a removable casing; however this device lacks a means for insertion in a portable electric drill.

U.S. Pat. No. 4,485,862 issued to Mattheis et al. on Dec. 4, 1984 describes a pencil sharpener adapted to sharpen a plurality of different sizes and to a method for making such a device. This device does not include a means for insertion in a portable electric drill or a cover that collects discharged pencil shavings and protects the user from accidental contact between the user and cutting blades.

U.S. Pat. No. 5,367,777 issued to Nguyen et al. on Nov. 29, 1994 describes a wooden pencil sharpener and pocket holder which allows a pencil to be stored in a shirt pocket such that the pencil sharpener and pencil point are contained within a tube and covered sharpener. The pencil is held in a tubular member. This device does not include a means for insertion in a portable electric drill.

U.S. Pat. No. 4,736,658 issued to Jore on Apr. 12, 1988 illustrates a screw holding device. This device illustrates a hexagonal end used for insertion in a portable electric drill.

None of the above noted inventions and patents, taken singly or in combination, is seen to describe the instant invention as claimed.

SUMMARY OF THE INVENTION

By the present invention, a device that includes a pencil sharpener with cover suitable for insertion into the chuck of a portable electric drill is disclosed.

OBJECTS AND ADVANTAGES

Accordingly, it is a principle objective of the present invention to provide a highly portable method for sharpening pencils at a work site when used in conjunction with a portable electric powered drill.

Another of the objects of the present invention is to proved a portable pencil sharpener which effectively prevents accidental contact between the user and the point cutting blade of the pencil sharpener while in use or stored waiting to be used.

Yet another of the objects of the present invention is to provide a portable pencil sharpener that may be used to hone a variety of tubular shapes requiring sharpened points, such as crayons and the like.

Still another of the objects of the present invention is to provide a portable pencil sharpener which can be used with existing bit holding attachments capable of receiving a hexagonal fitting.

An object of the present invention is to provide a portable pencil sharpener which is economical to produce.

It is an object of the invention to provide improved elements and arrangements thereof in an apparatus for the purposes described which is inexpensive, dependable and fully effective in accomplishing its intended purposes.

These and other objects of the present invention will be more readily apparent as the nature of the invention is hereinafter more fully described, illustrated and claimed with reference being made to the attached drawings.

Figure 1:
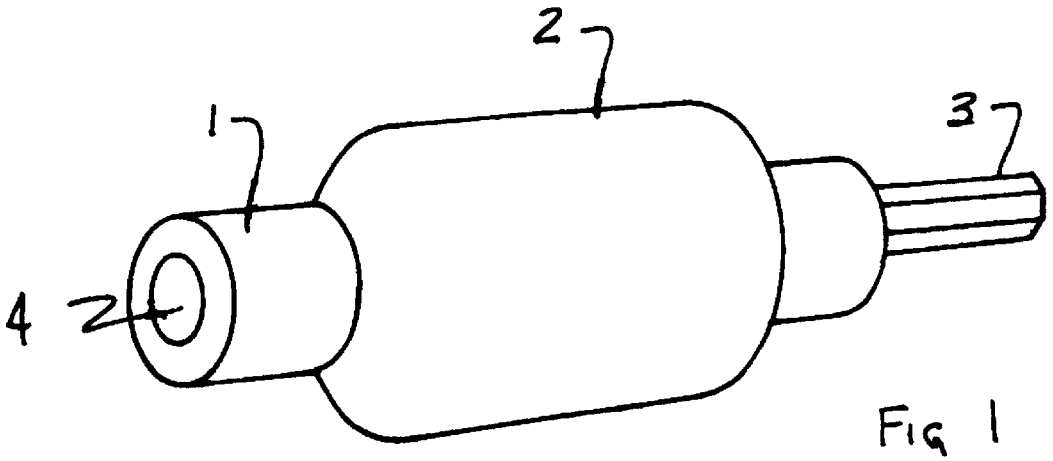
FIG. 1 is a perspective view of one embodiment of the pencil sharpener bit.

| Reference Numerals In Drawings |
| --- |
| 1 Cylindrical frame |
| 2 Cover |
| 3 Hexagonal end |
| 4 Pencil receiving inlet |
| 5 Discharge opening |
| 6 Point cutting assembly |

DETAILED DESCRIPTION OF THE PREFERRED EMBODIMENTS

The present invention is a portable pencil sharpener for use in a portable electric drill. The device is highly portable and can also be used in numerous currently produced bit holding attachments accepting bits with hexagonal ends.

Figure 2:
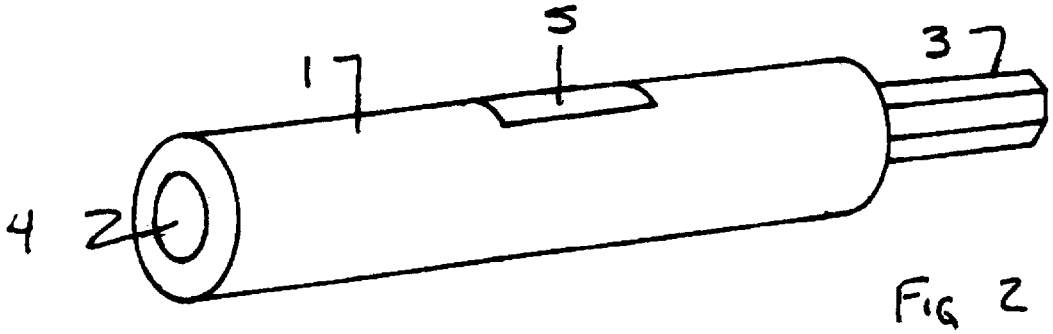
FIG. 2 is a perspective view of the invention as shown in FIG. 1, with the cover removed.
Figure 3:
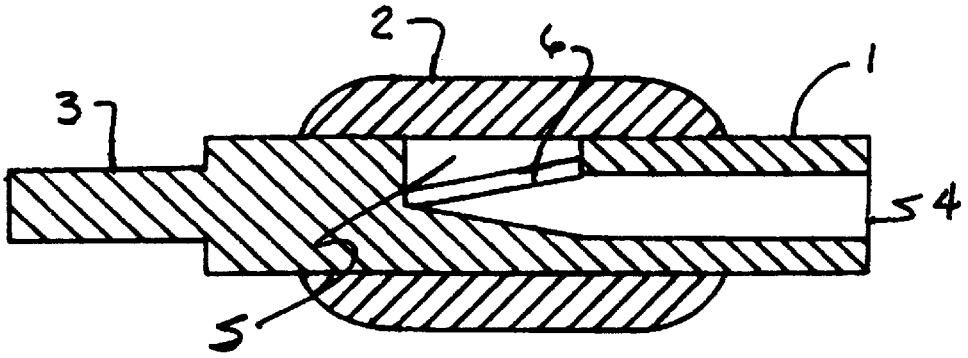
FIG. 3 is an exploded, sectional view taken generally along the midline of the longitudinal axis of the pencil sharpening bit.

Embodiments of the various aspects of the present invention will now be explained with reference to the accompanying drawings. By way of illustration and not limitations, FIGS. 1–3 are presented to show the preferred embodiments of the present invention.

All the embodiments presented include the novel feature of a pencil sharpener with a hexagonal end (3) which allows the pencil sharpener to be inserted into the chuck of a portable electric or battery powered portable drill. This hexagonal end (3) also allows the pencil sharpener to be used with existing bit holding attachments designed for use with such hexagonal drill bits and screw driver tips.

In one embodiment of the present invention, seen in FIG. 1, the pencil sharpener includes a cylindrical frame (1) with a cover (2) for collection of pencil shavings and protection from the point cutting assembly (6) and discharge opening (5) and a hexagonal end (3) for insertion in the chuck of a drill. A pencil receiving inlet (4) is located at the opposite end adapted to axially position a pencil into the point cutting assembly (5).

The cover (2) slides over the frame (1) for removal of collected shavings. With the cover (2) in place, the pencil shavings cannot be scattered by the rotation of the pencil sharpener and the user cannot accidentally contact either the point cutting assembly (6) or the discharge opening (5) in the frame.

In the embodiment shown in FIG. 3, the point cutting assembly (6) is shown in relationship to the pencil receiving inlet (4) and the discharge opening (5). It is preferred that the blade forming the point cutting assembly (6) be attached to the frame (1) in a manner that allows the pencil to be inserted in the pencil receiving inlet (4) and, as the pencil sharpener is turned in a clockwise rotation by the portable electric drill, small amounts of the pencil are removed, thus forming the sharpened point. Further, once the said point is formed, the point cutting assembly (6) prevents the pencil from continuing to be sharpened.

Most of the components of the present invention are made of plastic to reduce production costs, with the general exception of the point cutting assembly blade (6) which is preferably made of metal. The point cutting assembly blade is known to those skilled in the art, and hence variations thereof are hereby incorporated by reference.

It is to be understood that the present invention is not limited to the embodiments described above, but encompasses any and all embodiments within the scope of the following claims.

What is claimed is:

1. A pencil sharpener for use in a portable electric drill comprising:

a frame;

at least one point cutting assembly having:
a point cutting means; and a pencil receiving inlet adapted to axially position a pencil that is received into the pencil receiving inlet for cutting by said point cutting means;

a hexagonal shaped shank on the opposite end of the frame from the pencil receiving inlet to axially position the frame in the chuck of a portable electric drill;

a cover that attaches over said frame thereby collecting the discharge of pencil shavings, in addition to preventing accidental contact between user and the said point cutting means.

2. A pencil sharpener comprising:

a frame formed by a tubular housing;

a point cutting assembly having:
a single cutting edge; and a pencil receiving inlet adapted to axially position a pencil that is received into the pencil receiving inlet for cutting by said cutting means; and, a tubular housing with a hexagonal end opposite the pencil receiving inlet, such that the frame can be securely positioned in a portable electric drill.

3. The pencil sharpener as recited in claim 2, wherein said point cutting means includes:

a single edged cutting surface housed in the frame, and an opening in said frame adjacent to the cutting means to allow the discharge of pencil shavings.

4. The pencil sharpener as recited in claim 2, wherein said frame has a cover that completely encases said frame and collects the discharged pencil shavings; and prevents accidental contact with said point cutting means.

* * * * *